US005699555A

United States Patent [19]

Schunter

[11] Patent Number: 5,699,555

[45] Date of Patent: Dec. 23, 1997

[54] CHILD'S WAISTBELT AND LEASH FOR PROTECTION AGAINST ABDUCTION OF A CHILD

[76] Inventor: Christine K. Schunter, Box 980, Lumby, British Columbia, Canada, V0E 2G0

[21] Appl. No.: 755,229

[22] Filed: Nov. 22, 1996

[51] Int. Cl.[6] ..... A47D 13/08

[52] U.S. Cl. ..... 2/1; 2/312; 119/770; 119/857

[58] Field of Search ..... 2/1, 309, 311, 2/310, 312, 338, 232, 233; 54/1; 119/712, 769, 770, 792, 793, 795, 856, 857, 907

[56] References Cited

U.S. PATENT DOCUMENTS

| | | | |
|---|---|---|---|
| 2,275,983 | 3/1942 | Nadeau | 119/770 |
| 2,650,590 | 9/1953 | Moore et al. . | |
| 2,994,300 | 8/1961 | Grahling | 119/770 |
| 3,104,650 | 9/1963 | Grahling . | |
| 3,184,883 | 5/1965 | McCook | 2/311 |
| 3,295,501 | 1/1967 | Riley | 2/338 |
| 3,458,188 | 7/1969 | Infante | 2/312 |
| 3,884,190 | 5/1975 | Gurrey . | |
| 4,499,741 | 2/1985 | Harris . | |
| 4,621,589 | 11/1986 | Thinnes . | |
| 4,638,764 | 1/1987 | Anderson . | |
| 4,667,624 | 5/1987 | Smith . | |
| 4,688,564 | 8/1987 | Kelly . | |
| 4,699,090 | 10/1987 | Voorhees . | |
| 4,745,883 | 5/1988 | Baggetta | 119/770 |
| 4,751,896 | 6/1988 | Miley . | |
| 4,759,311 | 7/1988 | Boyle . | |
| 4,765,279 | 8/1988 | Klickstein . | |
| 4,854,138 | 8/1989 | Charland . | |
| 4,867,464 | 9/1989 | Cook . | |
| 5,069,168 | 12/1991 | Roberson et al. | 119/770 |
| 5,080,045 | 1/1992 | Reese et al. | 119/770 |
| 5,119,767 | 6/1992 | Jimenez . | |
| 5,259,338 | 11/1993 | Cornell . | |
| 5,275,178 | 1/1994 | Roberson et al. . | |
| 5,325,818 | 7/1994 | Leach | 119/770 |
| 5,351,654 | 10/1994 | Fuentes | 119/770 |
| 5,388,551 | 2/1995 | Martuscielo . | |
| 5,423,292 | 6/1995 | Hall . | |
| 5,447,121 | 9/1995 | Spence . | |
| 5,485,811 | 1/1996 | Jacobsen et al. . | |
| 5,540,188 | 7/1996 | Heinrichs | 119/770 |

FOREIGN PATENT DOCUMENTS

| | | | |
|---|---|---|---|
| 270267 | 5/1927 | Canada . | |
| 1095864 | 2/1981 | Canada . | |
| 1270472 | 6/1990 | Canada . | |
| 2113436 | 2/1993 | Canada . | |
| 2081647 | 4/1994 | Canada . | |
| 2080643 | 3/1995 | Canada . | |
| 2135504 | 5/1995 | Canada . | |
| 2010507 | 7/1995 | Canada . | |
| 1007567 | 5/1952 | France | 2/338 |

*Primary Examiner*—Gloria Hale
*Attorney, Agent, or Firm*—Antony C. Edwards

[57] ABSTRACT

A child's waistbelt and leash for protection against abduction of a child including a flexible waistbelt having a length and a releasably securable closure, a releasably securable flexible cover, releasably securable over the releasably securable closure, the releasably securable flexible cover securely affixed to the flexible waistbelt, a leash having opposed first and second ends securely affixed at the first end to the releasably securable flexible cover, and a flexible cover securing loop affixed to and extending from the first end of the leash adapted to cooperate with the leash so that the releasably securable flexible cover may be releasably secured over the releasably securable closure and the flexible cover securing loop tightened around the releasably securable closure when the leash is tensioned by pulling the leash against a resisting force of the flexible waistbelt when worn by a child.

8 Claims, 5 Drawing Sheets

CHILD'S WAISTBELT AND LEASH FOR PROTECTION AGAINST ABDUCTION OF A CHILD

FIELD OF THE INVENTION

This invention relates to the field of child tethering devices and specifically to devices for tethering a child to an adult by means of a harness, leashes, safety lines or other restraining devices.

BACKGROUND OF THE INVENTION

It is well recognized that children in some situations, typically in crowded public areas, and especially young children, for their safety should be secured to an adult, usually a parent. This is particularly so in view of the risk of child abduction in crowded public places where a child may step away momentarily from the adult and become separated.

Thus it is an object to provide a releasably securable comfortable device to be worn by a child in the manner of a flexible belt, but which is releasably securable in such a manner that the releasable closure can not be operated without the consent and cooperation of the supervising adult, it being a further object of the present invention to provide a flexible restraining leash secured to the releasably securable waist belt where both the waist belt and the leash are reinforced so as to resist attempts to cut or otherwise sever the waistbelt or leash.

In the prior art, Applicant is aware of U.S. Pat. No. 4,745,883 which issued to Baggetta on May 24, 1988 for a Safety Tether Device. The Baggetta tether device includes a resiliently stretchable leash having loops formed at opposed ends of the leash so as to provide elastic wrist bands. It is neither taught nor suggested to provide a releasably securable closure so as to secure a releasably securable waistband around a child, where the closure is protected by a self-tightening cover tightened by a tension force applied to the leash. Further, it is neither taught nor suggested to reinforce the waistband and leash.

Applicant is also aware of other attempts in the prior art, and in particular, U.S. Pat. No. 5,275,178 which issued to Roberson 'et al' on Jan. 4, 1994 for a Method of Identifying a Child, U.S. Pat. No. 4,765,279 which issued to Klickstein on Aug. 23, 1988 for a Child to Adult Tether, U.S. Pat. No. 4,751,896 which issued to Miley on Jun. 21, 1988 for an Adult and Child Tether Assembly, U.S. Pat. No. 5,388,551, which issued to Martusciello on Feb. 14, 1995 for a Convertible Harness System, U.S. Pat. No. 5,259,338 which issued to Cornell on Nov. 9, 1993 for a Safety Harness for Children, U.S. Pat. No. 4,854,138 which issued to Charland for a Restraining Device, and U.S. Pat. No. 4,688,564 which issued to Kelly for a Security Device for Young Children, none of which teach or suggest the above-described advantages of the present invention.

SUMMARY OF THE INVENTION

In a first aspect of the invention the waistbelt and leash includes a wire-reinforced waistband, a permanently secured padded fabric cover adapted to conceal the waistbelt fastening and size adjusting clips, and a permanently secured wire-reinforced hand-held leash tightenable around the padded fabric cover.

In summary, in a further aspect, the child's waistbelt and leash of the present invention for protection against abduction of a child includes:

(a) a flexible waistbelt having a length and a releasably securable closure, (b) a releasably securable flexible cover, releasably securable over the releasably securable closure, the releasably securable flexible cover securely affixed to the flexible waistbelt, (c) a leash having opposed first and second ends securely affixed at the first end to the releasably securable flexible cover, and (d) a flexible cover securing means affixed to and extending from the first end of the leash adapted to cooperate with the leash so that the releasably securable flexible cover may be releasably secured over the releasably securable closure and the flexible cover securing means tightened around said releasably securable closure when said leash is tensioned by pulling said leash against a resisting force of said flexible waistbelt when worn by a child.

Advantageously the flexible waistbelt is adapted to resist cutting or severing of the flexible waistbelt by means for resisting cutting of the flexible waistbelt mounted into the flexible waistbelt along generally the length of the flexible waistbelt.

Further advantageously, the leash includes means for resisting cutting of the leash mounted into the leash along generally a length of the leash.

Yet further advantageously, the means for resisting cutting of the flexible waistbelt and the means for resisting cutting of the leash are flexible wires journalled in longitudinal flexible cavities along generally the length of the flexible waistbelt and the leash, the flexible wires secured at their ends to the flexible waistbelt and the leash respectively.

In one aspect to the invention, the releasably securable flexible cover is a flexible sheet secured to the flexible waistbelt and adapted to be wrapped around and enclose the releasably securable closure, and the flexible cover securing means is a flexible loop secured at ends of the loop to the flexible sheet or the leash, the flexible loop wrappable at least partially around the flexible sheet and around the releasably securable closure when the flexible sheet is wrapped around the releasably securable closure, the flexible loop adapted to receive the leash through the flexible loop so that the leash, when tensioned, tightens the flexible loop around the releasably securable closure in the manner of a noose to thereby prevent access to, and release of, the releasably securable closure.

Further advantageously, the flexible waistbelt may have a waist size adjustment means, the waist size adjustment means including, at an end of the flexible waistbelt adjacent the releasably securable closure, a portion of the flexible waistbelt not incorporating the flexible wire, a second releasably securable cover, adapted to resist cutting or severing of the portion of the flexible waistbelt, releasably securable over the portion of the flexible waistbelt not incorporating the flexible wire.

Still further advantageously, the second releasably securable cover is a thick fabric cover jacket releasably securable over the portion of the flexible waistbelt not incorporating the flexible wire.

DETAILED DESCRIPTION OF THE PREFERRED EMBODIMENT

Figure 1:
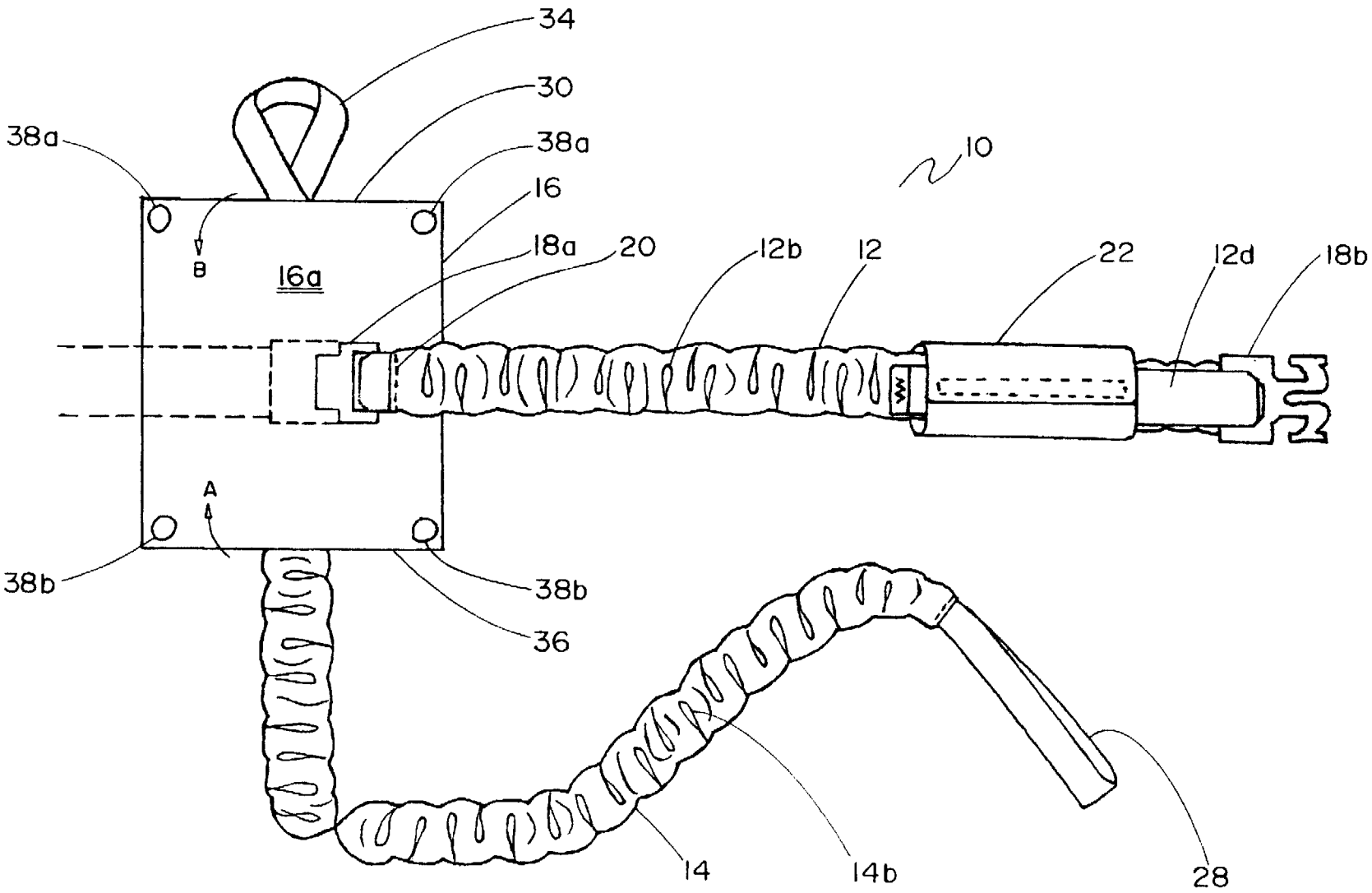
FIG. 1 is the waistbelt and leash of the present invention with the waistbelt clasp cover opened.
Figure 2:
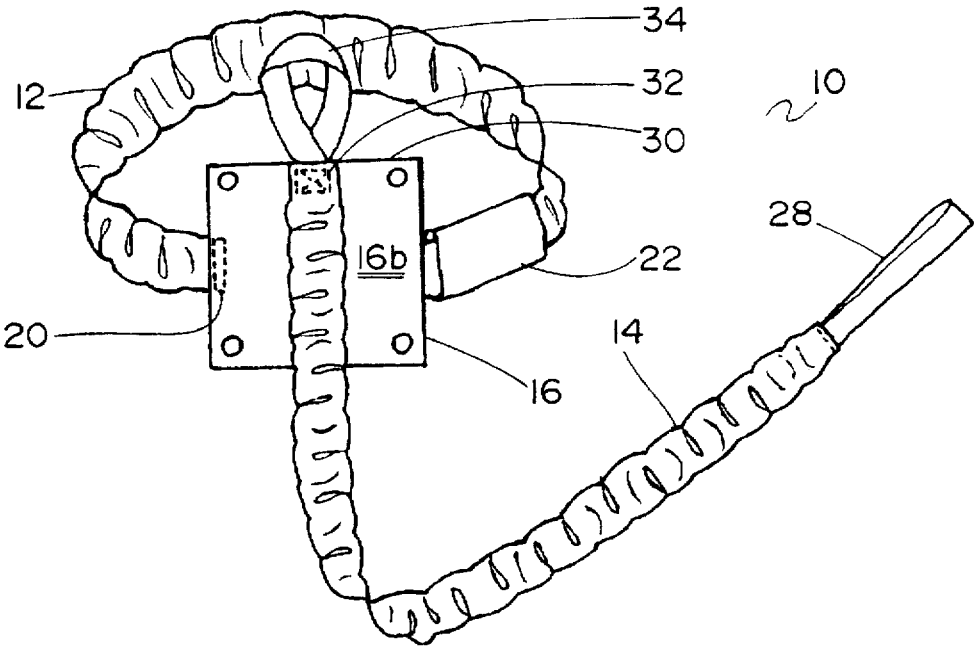
FIG. 2 is the waistbelt and leash of FIG. 1 in perspective view with the waistbelt clasp closed and the waistbelt clasp cover open.

In the preferred embodiment, and as illustrated in FIG. 1, a unitary child waistbelt and leash 10 is provided wherein waistbelt 12 is secured to leash 14 by means of cover 16, as better seen in FIG. 2.

Figure 3:
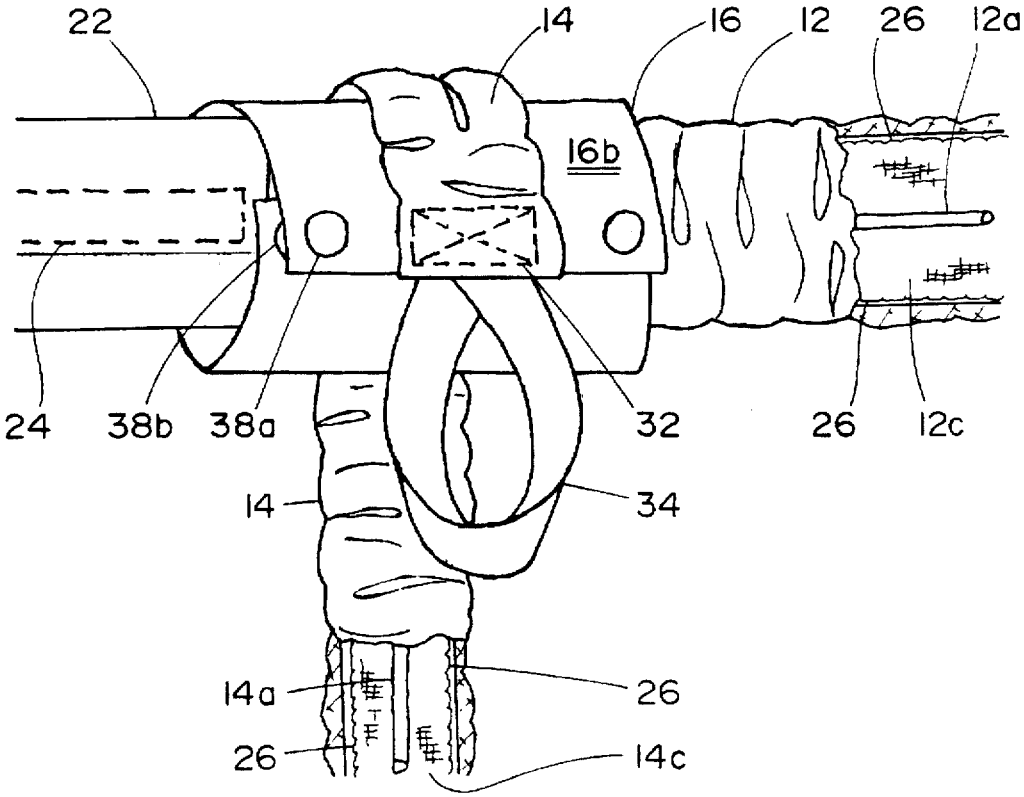
FIG. 3 is, in an enlarged, partially cutaway view, of the waistbelt clasp cover in the closed position.

Waistbelt 12 has releasably securable clips 18, and in particular clip portions 18*a* and 18*b*, at either end of the waistbelt for releasable securing of the waistbelt around the waist of a child. One end of waistbelt 12 is secured, as by stitching, to an interior surface 16*a* of cover 16, which in the preferred embodiment is one side of a flexible sheet. Waistbelt 12 is stitched to cover 16 so as to secure clip portion 18*a* against the interior surface 16*a* of cover 16 so as to be enclosed therein when cover 16 is wrapped around clips 18 when clips 18 are releasably secured as better depicted in FIG. 3. In FIG. 3, where cover 16 has been wrapped around releasably secured clips 18 so as to enclose them within cover 16.

The end of waistbelt 12 not secured to cover 16, that is, the free end of the waistbelt, is selectively adjustably secured to clip portion 18*b*. Thus, as illustrated, clip portion 18*a* is secured to cover 16 and corresponding mating clip portion 18*b* is selectively adjustably secured to the free end of waistbelt 12 so that the length of waistbelt 12 can be selectively adjusted to provide a snug fit around the waist of a child.

In the preferred embodiment, waistbelt 12 is formed of a cloth sleeve having a resilient wire or the like, such as Kevlar (TM) rope, journalled therethrough to provide non-resilient flexible reinforcement to thereby resist cutting or severing of waistbelt 12. Advantageously, the flexible wire may be plastic coated 16 gauge wire extending from the end of waistbelt 12 at clip 18*a* and stitched into securement to cover 16 by stitching 20. The flexible wire 12*a*, better seen in FIG. 3, is journalled the length of waistbelt 12 excepting that portion of waistbelt 12 which may be threaded through clip portion 18*b*, where the non-reinforced portion 12*d* of waistbelt 12 may be a non-reinforced portion of the sleeve or a strip of cloth secured to, and extending therefrom. The non-reinforced portion 12*d* of waistbelt 12 may advantageously be protected, so as to inhibit cutting or severing of waistbelt 12, by means of a second flexible cover 22 which may be formed of a cuff or sleeve or thick material releasably securable by means of hook and loop fasteners indicated by dotted outline 24.

In the preferred embodiment, leash 14 is constructed in a similar fashion to waistbelt 12 in that leash 14 is a tubular sleeve of cloth having a length of flexible wire 14*a* journalled therethrough and secured as by stitching at each end.

Both waistbelt 12 and leash 14 may be made of tubular cloth sleeves which are gathered along their length into gathers 12*b* and 14*b*, respectively, sewn onto, for example, longitudinally extending elastic strips 12*c* and 14*c* respectively. Waistbelt 12 and leash 14 may be formed into gathers 12*b* and 14*b* for comfort, respectively, by means of stitching 26 between elastic strips 12*c* and 14*c* and the corresponding gathers 12*b* and 14*b*. Gathers 12*b* and 14*b* and elastic strips 12*c* assist in padding wires 12*a* around the waist of a child.

The free end of leash 14 may be provided with a handle such as loop 28, which may be secured as by stitching across the end of leash 14. The opposed end of leash 14 is secured to edge 30 on cover 16 by means of stitching 32 so as to lay leash 14 across outer surface 16*b* of cover 16 generally perpendicular to the orientation of waistbelt 12 secured at stitching 20 to the interior surface 16*a* of cover 16. Stitching 32 also secures loop 34 so that loop 34 protrudes outwardly of edge 30 on cover 16.

Thus in operation, waistbelt 12 is adjusted to the correct size to snugly fit around the waist of a child and the non-reinforced portion of waistbelt 12 extending through clip portion 18*b* is folded back along waistbelt 12 and covered by second flexible cover 22. Clips 18 are then releasably secured by mating engagement of clip portion 18*a* with clip portion 18*b* so that the interior surface 16*a* of cover 16 is facing inwardly towards the child. Edge 36 is then folded upwardly so as to tuck up and in behind mated clip portions 18*a* and 18*b* by folding edge 36 of cover 16 upwardly in direction A. Edge 30 of cover 16 may then be folded downwardly in direction B so as to fold snap portions 38a over corresponding mating snap portions 38*b*, or so as to mate other types of corresponding mating fasteners such as hook and loop fasteners, whereby cover 16 may be releasably closed so as to enclose mated clip portions 18*a* and 18*b*.

Figure 4:
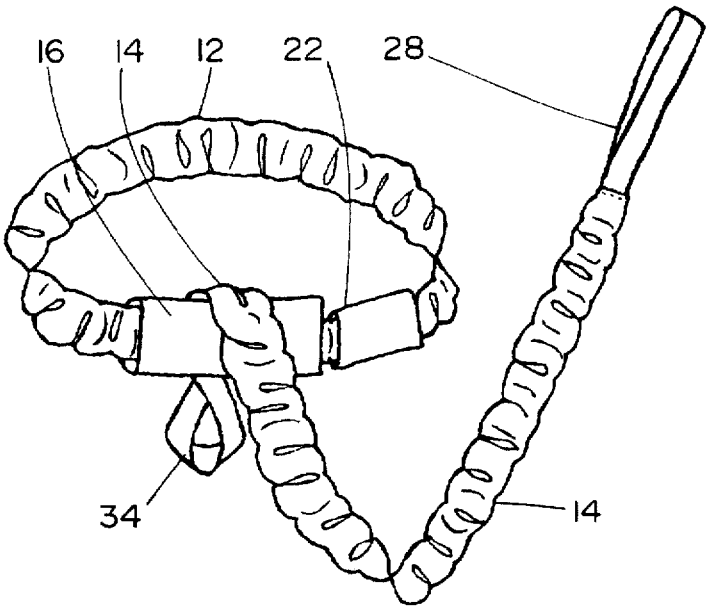
FIG. 4 is, in perspective view, the waistbelt and leash of FIG. 2 with the waistbelt clasp cover closed.

With edge 30 folded over so as to overlap edge 36, loop 34 extends downwardly so as to protrude downwardly beneath cover 16 and so as to extend from between cover 16 and the child. Loop 34 in this position is best seen in FIG. 4.

Figure 5:
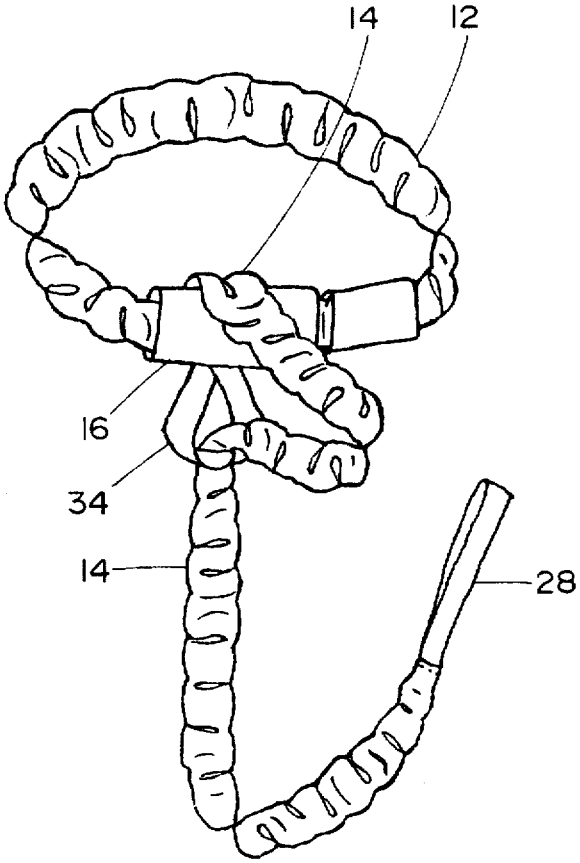
FIG. 5 is, in perspective view, the waistbelt and leash of FIG. 4 with the leash being threaded through the loop attached to the waistbelt clasp cover.
Figure 6:
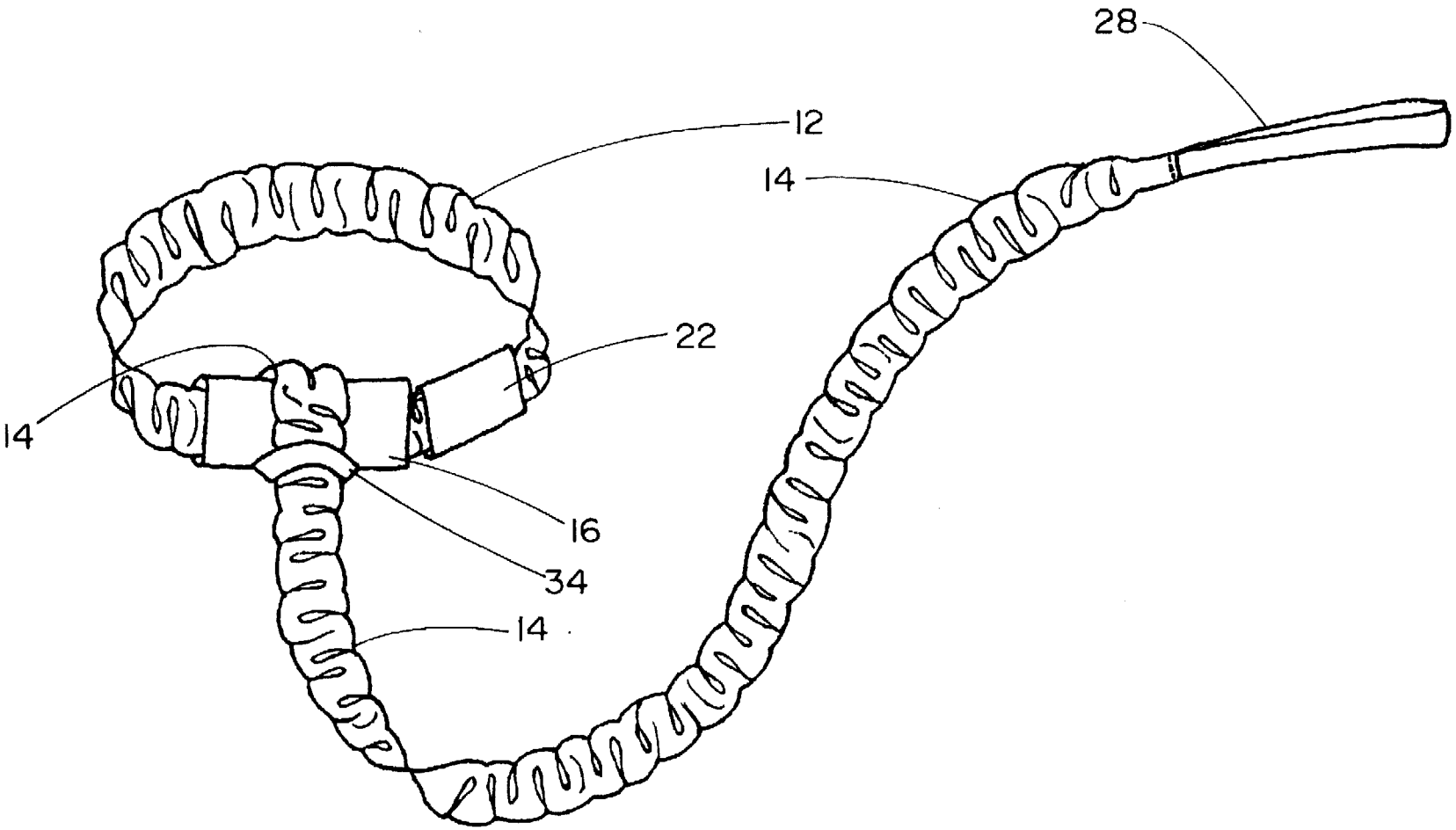
FIG. 6 is, in perspective view, the waistbelt and leash of FIG. 5 with the leash threaded through and tensioned through the loop so as to encircle the enclosed waistbelt clasp cover.
Figure 7:
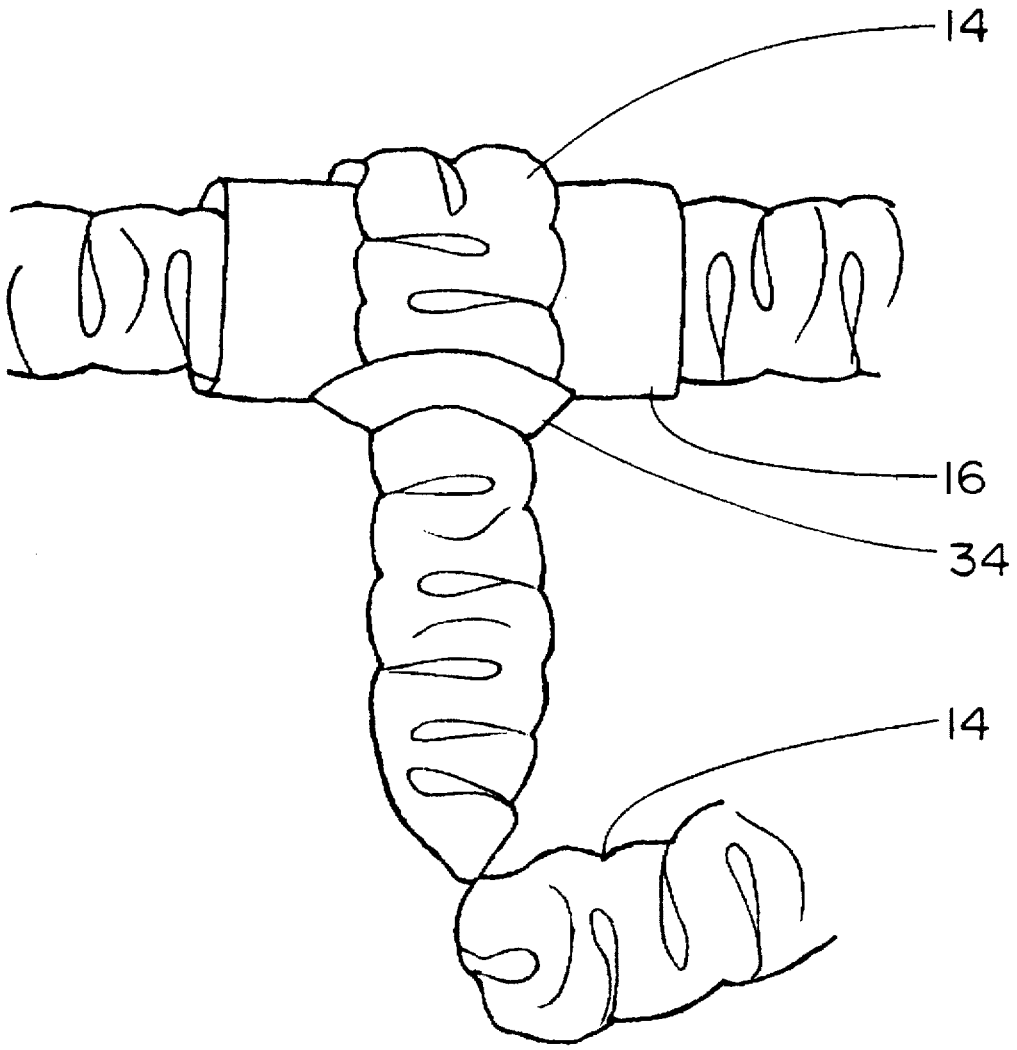
FIG. 7 is, in an enlarged view, the waistbelt clasp cover encircled by the leash threaded and tensioned through the loop.

As seen in FIGS. 5–7, leash 14 may be threaded through loop 34 as loop 34 protrudes downwardly from behind cover 16, and leash 14 tightened so that leash 14 and loop 34 snugly encircle cover 16. As may be seen, tensioning leash 14 slides leash 14 through loop 34 thereby tightening cover 16 wrapped around mated clip portions 18*a* and 18*b*.

Applicant's corresponding United States provisional patent application Ser. No. 60/006,373 filed Nov. 24, 1995 is hereby incorporated by reference.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A child's waistbelt and leash for protection against abduction of a child comprising:

(a) a flexible waistbelt having a length and a releasably securable closure, (b) a releasably securable flexible cover, releasably securable over said releasably securable closure, said releasably securable flexible cover securely affixed to said flexible waistbelt, (c) a leash having opposed first and second ends securely affixed at said first end to said releasably securable flexible cover, and (d) a flexible cover securing means affixed to and extending from said first end of said leash adapted to cooperate with said leash so that said releasably securable flexible cover may be releasably secured over said releasably securable closure and said flexible cover securing means tightened around said releasably securable closure when said leash is tensioned by pulling said leash against a resisting force of said flexible waistbelt when worn by a child.

2. The device of claim 1 wherein said flexible waistbelt is adapted to resist cutting or severing of said flexible waistbelt by means for resisting cutting of said flexible waistbelt mounted into said flexible waistbelt along generally said length of said flexible waistbelt.

3. The device of claim 2 wherein said leash further includes means for resisting cutting of said leash mounted into said leash along generally a length of said leash.

4. The device of claim 3 wherein said means for resisting cutting of said flexible waistbelt and said means for resisting cutting of said leash are flexible wires journalled in longitudinal flexible cavities along generally said length of said flexible waistbelt and said leash, said flexible wires secured at their ends to said flexible waistbelt and said leash respectively.

5. The device of claim 1 wherein said releasably securable flexible cover is a flexible sheet secured to said flexible waistbelt and adapted to be wrapped around and enclose said releasably securable closure, said flexible cover securing means is a flexible loop secured at ends of the loop to said flexible sheet or said leash, said flexible loop wrappable at least partially around said flexible sheet and around said releasably securable closure when said flexible sheet is wrapped around said releasably securable closure, said flexible loop adapted to receive said leash through said flexible loop so that said leash, when tensioned, tightens said flexible loop around said releasably securable closure in the manner of a noose to thereby prevent access to, and release of, said releasably securable closure.

6. The device of claim 4 wherein said flexible waistbelt may have a waist size adjustment means, said waist size adjustment means including, at an end of said flexible waistbelt adjacent said releasably securable closure, a portion of said flexible waistbelt not incorporating said flexible wire, a second releasably securable cover, adapted to resist cutting or severing of said portion of said flexible waistbelt, releasably securable over said portion of said flexible waistbelt.

7. The device of claim 6 wherein said second releasably securable cover is a thick fabric cover jacket releasably securable over said portion of said flexible waistbelt.

8. A waistbelt and leash for use as a measure of protection against child abductions comprising a wire-reinforced waistband having, at opposite ends, waistbelt fastening and size adjusting clips, a permanently secured padded fabric cover adapted to conceal said waistbelt fastening and size adjusting clips, and a permanently secured wire-reinforced handheld leash tightenable around said padded fabric cover.

* * * * *